US006691496B2

(12) United States Patent
Peña

(10) Patent No.: US 6,691,496 B2
(45) Date of Patent: Feb. 17, 2004

(54) ADVERTISING ARRANGEMENT APPLICABLE TO LAMINAR STRIPS OF PLASTIC MATERIAL FOR SHRINK-WRAPPING AND PROTECTING LUGGAGE

(76) Inventor: Norberto Chinique Peña, C/ Enrique López, 18, 28022 Madrid (ES)

( * ) Notice: Subject to any disclaimer, the term of this patent is extended or adjusted under 35 U.S.C. 154(b) by 0 days.

(21) Appl. No.: 09/844,810

(22) Filed: Apr. 27, 2001

(65) Prior Publication Data

US 2002/0127394 A1 Sep. 12, 2002

(30) Foreign Application Priority Data

Apr. 27, 2000 (ES) ..... P. 20001087

(51) Int. Cl.[7] ..... B65B 43/42
(52) U.S. Cl. ..... 53/572; 156/277; 156/566
(58) Field of Search ..... 53/557, 131.4, 53/131.2, 131.3, 131.5, 411; 156/85, 86, 277, 556, 566, 542, 55, 441.5, DIG. 35

(56) References Cited

U.S. PATENT DOCUMENTS 3,562,059 A * 2/1971 Gladen ..... 156/277
3,575,755 A * 4/1971 Cutler et al. ..... 101/32
3,760,154 A * 9/1973 Konger ..... 206/497
3,777,445 A * 12/1973 Anderson ..... 53/131.2
4,263,077 A * 4/1981 Rampelberg ..... 101/32
4,264,657 A * 4/1981 Tollette ..... 156/239
4,332,193 A * 6/1982 Noyes ..... 101/35
4,390,390 A * 6/1983 Margraf et al. ..... 156/566
5,190,609 A * 3/1993 Lin et al. ..... 156/247
5,337,132 A * 8/1994 Cherian ..... 156/277
5,368,666 A * 11/1994 Terada ..... 156/282
5,388,384 A * 2/1995 Purkey et al. ..... 53/131.2
5,582,570 A * 12/1996 Crowley ..... 156/277
5,599,416 A * 2/1997 Kuwahara ..... 156/219
5,890,345 A * 4/1999 Bauer ..... 53/399
6,361,640 B1 * 3/2002 Kamen et al. ..... 118/211
6,364,993 B1 * 4/2002 Netsch et al. ..... 156/277
6,395,125 B1 * 5/2002 Bradford ..... 156/223
6,425,324 B1 * 7/2002 Yamamoto ..... 101/34
6,440,249 B1 * 8/2002 Swinburne ..... 156/230

* cited by examiner

*Primary Examiner*—Rinaldi I. Rada
*Assistant Examiner*—Paul Durand
(74) *Attorney, Agent, or Firm*—Alfred M. Walker

(57) ABSTRACT

An advertising arrangement applicable to laminar strips of plastic material for shrink-wrapping and protecting luggage, which consists of incorporating inside the tunnel (3) of a machine for protecting luggage means for positioning labels (5) and (5') of any shape considered appropriate, provided with means for fixing in the central area of the luggage (9). The labels to be incorporated or the similar means are made up of a spool (6) and (6') situated in the upper part and tensioned in the lower part by appropriate means (7) and (7'). The luggage (9) exits by means of a conveyor or roller belt (4').

14 Claims, 2 Drawing Sheets

ADVERTISING ARRANGEMENT APPLICABLE TO LAMINAR STRIPS OF PLASTIC MATERIAL FOR SHRINK-WRAPPING AND PROTECTING LUGGAGE

OBJECT OF THE INVENTION

The present specification refers to a Patent of Invention application relating to an advertising arrangement applicable to laminar strips of plastic material for shrink-wrapping and protecting luggage, whose purpose is to incorporate on the laminar body, positioned on the larger sides of the body of the duly shrink-wrapped and protected luggage, an area showing graphics by conventional means which constitutes the advertising to be incorporated. Said advertising is situated on the sheet prior to the dispatch of the duly protected luggage, this operation being carried out automatically, incorporating advertising about a single subject, two subjects or several subjects. The incorporated advertising occupies the central area of the duly protected luggage.

The arrangement that is the object of the invention may use a plastic sheet with dimensions in accordance with the luggage to be protected, upon which the graphic display in question has been previously incorporated in appropriate areas so that these graphic displays which constitute advertising in general are situated on the surface corresponding to the central area of the larger sides.

FIELD OF THE INVENTION

The application of this invention is in the industry which manufactures devices for protecting luggage situated in airports, railway stations, bus stations, hotels, etc. It may also be used by the advertising industry in general.

BACKGROUND OF THE INVENTION

The applicant is aware of the existence of machines for shrink-wrapping and protecting luggage situated at different points, which use a sheet of plastic material of greater or lesser strength for shrink-wrapping and protecting luggage adequately.

The invention uses a sheet of transparent, translucent or opaque plastic material of greater or lesser thickness and, according to the dimensions of the luggage to be protected. Said sheet is attached to the outside of the luggage by mechanical means and at the end of the machine's operation it surrounds and shrink-wraps the luggage in question, generally using a sheet of transparent plastic material in order to enable the owner of the luggage to view and arrange the luggage in question so as to be able to identify it at the collection and transportation points.

It is established that when a continuous sheet is used to shrink-wrap luggage of different shapes and sizes, and although the sheet incorporates advertising texts on its surface, these texts do not, except accidentally, remain centered on the surface of the larger sides, which is the place considered to be most suitable for their display and subsequent announcement of the advertising message. Moreover, the message will not be visible, but displaced from the central area; and, of course, it will not be visible at all if the advertising display areas are shrink-wrapped in such a way that they are situated in the upper or lower part.

In view of what is described above, it is necessary to use a machine to shrink-wrap and protect luggage which uses a sheet of appropriate plastic material, but at the same time, in order to maximise the effectiveness of an advertising message, it is indispensable to apply to the sheet of transparent, translucent or opaque plastic material means which make up an advertising device which situates the graphic display of the advertising message at a point in the shrink-wrapping where it is situated monovalently or polyvalently on the larger sides of the shrink-wrapped luggage, and obviously centered.

However, the applicant is not aware of the existence at the present time of an invention that is provided with the features indicated above as being suitable.

DESCRIPTION OF THE INVENTION

The advertising arrangement applicable to laminar strips of plastic material for shrink-wrapping and protecting luggage proposed by the invention, is in itself an evident novelty within its field of application, as it allows an advertising message, which may be monovalent or polyvalent and which is properly positioned, to be incorporated on the sides of shrink-wrapped and protected luggage.

More specifically, the advertising arrangement applicable to laminar strips of plastic material for shrink-wrapping and protecting luggage that is the object of the invention is formed by incorporating two parts at the exit of the protective machine which are situated adjacent to the theoretical larger sides in the inner area. On said two parts, by means of a hydraulic piston provided with heating means for electro-welding, an appropriately decorated and silk screen printed label is made, which is fixed to the larger sides of the suitcase in question, remaining stationary and centered.

By means of this operation, the machine can also incorporate a direct silk screen print using appropriate material upon the surface of the luggage.

DESCRIPTION OF THE DRAWINGS

To complement the description that is being given and in order to promote a better understanding of the features of the invention, the present specification is accompanied, as an integral part of the same, by a sheet of drawings in which, by way of illustration and non-restrictively, the following is represented:

FIG. 3 demonstrates the current invention in process of performing the object of the invention.

FIG. 4 illustrates the finished product resulting from the current invention.

PREFERRED EMBODIMENT OF THE INVENTION

Figure 1:
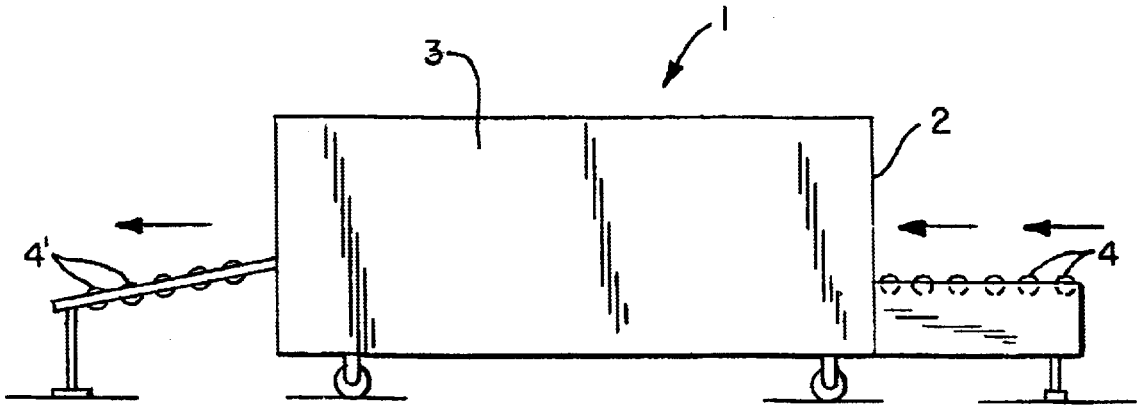
FIG. 1 is a side elevation view of a machine or device for protecting luggage in airports, railway stations, bus stations, ports and hotels, inside which the object of the invention is incorporated, which relates to an advertising arrangement applicable to laminar strips of plastic material, for shrink-wrapping and protecting luggage.
Figure 2:
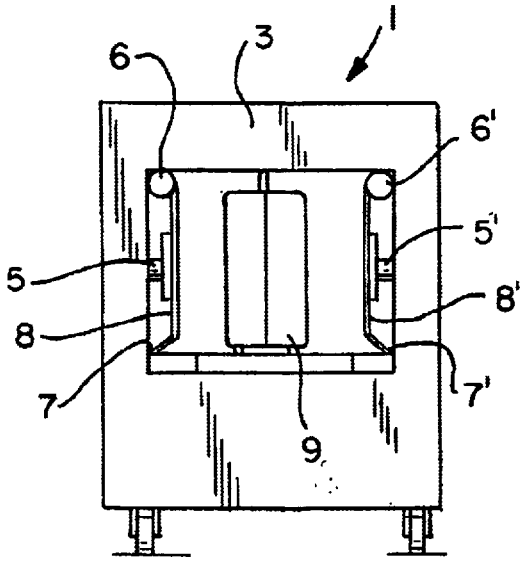
FIG. 2 shows a front elevation of the object represented in FIG. 1, through whose operating mouth the elements comprising the object of the invention can be seen.

In the light of these drawings, it may be observed that the proposed advertising arrangement applicable to laminar strips of plastic material for shrink-wrapping and protecting luggage is made up of a machine for protecting luggage (1) by shrink-wrapping, which uses sheets of plastic material to protect the suitcases or the like, which enter through the opening (2) by means of a conveyor belt (4) that incorporates them inside the tunnel (3), in which all the appropriate elements are situated for carrying out the relevant shrink-wrapping and protection of the luggage. The latter exit duly protected, by means of the conveyor belt or roller belt (4').

Close to the exit of the body (3) in front of the entrance (2) two pistons (5) and (5') are situated, which are operated by conventional means, provided with electro-welding means and photo-sensitive cells, to appropriately position the advertising which is displayed on a label or conveyor strip (8) and (8'). These labels, silk screen prints or the like will be positioned on the larger sides of the suitcase (9). The conveyor strip of the labels is situated on spools (6) and (6'), which are tensed in their lower part by conventional means (7) and (7'). Therefore, once the duly shrink-wrapped suitcase is situated in front of the positioning elements (5) and (5'), these position the elements (5) and (5') at an appropriate height according to the photo-sensitive cells and then approach the sides of the duly covered suitcase (9), incorporating the label on the central area by means of thermal bonding; or the elements (5) and (5') act as conventional silk screen elements which transfer the image to the covered sides of the body of the suitcase (9).

Figure 3:
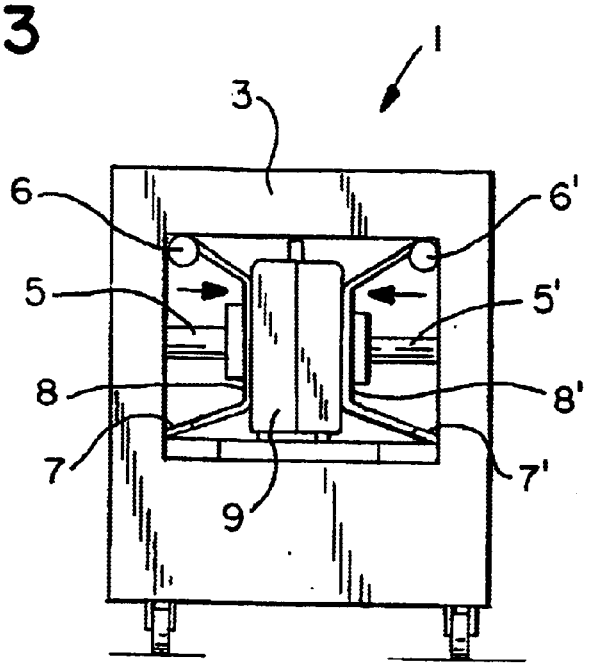
FIG. 3 shows a front elevation of the object represented in FIG. 1 and FIG. 2. through whose operating mouth the elements comprising the object of the invention can bee seen.
Figure 4:
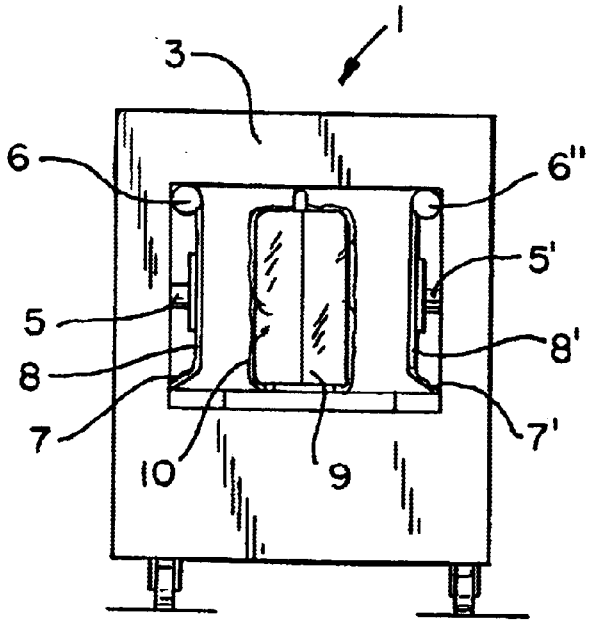
FIG. 4 shows a front elevation of the object represented in FIG. 1 and FIG. 2, through whose operating mouth the elements comprising the object of the invention can be seen.

This bonding operation is demonstrated in FIG. 3. The elements (5) and (5'), upon locating the central area of the luggage, move inward in the direction indicated. The shrink-wrap sheets (8) and (8') are pressed onto the luggage (9), unrolling from the spools (6) and (6').

Once the suitcase (9) has left the body (3) by means of the roller track (4'), the luggage situated there subsequently will be similarly treated and the elements (5) and (5') duly positioned in its central area according to the luggage's specific size.

Resulting from the preferred embodiment of the current invention is a suitcase (9) enclosed by shrink-wrap sheets (8) and (8') and sealed by a sealing method as described herein. The resulting shrink-wrap seal (10) thus comprises the original sheets (8) and (8').

It must be pointed out that the invention is able to prevent the operation of the positioning elements (5) and (5') of the labels or sheets (8) and (8'), if their dimensions or contours do not allow it.

The invention allows the operation to take place on suitcases that are shrink-wrapped and protected by sheets of transparent, opaque or translucent plastic material.

It must also be pointed out that, as an option, labels of previously printed paper may be incorporated which, together with self-adhesive that can be crystallised by heat, are fixed to the surface of the plastic which carries out the shrink-wrapping and protection of the suitcase (9).

As we stated above, this invention may incorporate shrink-wrapping sheets that incorporate the advertising image applicable to standard luggage dimensions, using the conventional shrink-wrapping spool when the suitcases to be treated and protected are not of the appropriate dimensions.

Logically, the invention may operate by using bags of plastic material with dimensions that are appropriate to the volume of the luggage to be protected, the advertising having been previously applied to said bags, occupying a rectangular space in a single advertising presentation or multiple presentations.

In accordance with the structure described in the foregoing paragraph and in the characteristics of this invention, it may be stated that the invention may use two spools for pre-shrinking, which have been previously provided with an advertising image on the same. The operation of wrapping the luggage itself with plastic from the spools is carried out, and then shrink-wrapping takes place in the heat tunnel.

To summarise this optional embodiment, the advertising may be done by using spools that are spliced together and provided with previously printed advertising, thus achieving the use of a sheet which envelops the suitcase or luggage, which is shrink-wrapped by means of a conventional heating system. This has the advantage of achieving spools that are previously provided with advertising, spliced together and previously printed, with which the suitcase is wrapped.

It is not considered necessary to prolong this description so that any expert in the subject can understand the scope of the invention and the advantages arising from the same.

The materials, shape, size and arrangement of the elements may be varied, provided that this does not mean any alteration to the essential nature of the invention.

The terms in which this report has been drawn up are to be taken always in their broad and non-restrictive sense.

What is claimed is:

1. An advertising arrangement used with luggage being shrink wrapped for protecting luggage, comprising a shrink-wrap applicator means incorporated inside a tunnel (3) of a machine protecting luggage (9) by shrink wrapping a sheet of plastic material around said luggage, said luggage (9) having a pair of larger size side panels joined by smaller front, rear, top and bottom portions, wherein said luggage (9) to be covered by said sheet of plastic material incorporating an advertising image enters said tunnel (3) by being advanced forward by a leading carrier (4) through an entrance (2) of said tunnel (3); said shrink-wrap applicator means shrink-wrapping said sheet of plastic material on said luggage leaving visible said advertising image, wherein said advertising image is exposed to at least one larger size side panel of said body of said suitcase (9), said shrink-wrap applicator means having at least one fixing element (5), (5') fixing said sheet of plastic material with said advertising image, said sheet of plastic material being held in place by tensors (7) and (7') situated in a lower part of said shrink-wrap applicator; said fixing elements (5), (5') being moved by at least one actuator.

2. An advertising arrangement as claimed in claim 1, wherein said means for applying said sheet of plastic material having an advertising image incorporated therein includes a photo-sensitive cell for locating said advertising image on said luggage.

3. An advertising arrangement as claimed in claim 1, wherein said fixing elements (5) and (5') are provided with stopping means when said suitcase (9) has an irregular contour.

4. An advertising arrangement as claimed in claim 1, wherein said sheet of plastic material has multiple advertising images occupying multiple areas of the luggage (9).

5. An advertising arrangement as claimed in claim 1, wherein said shrink-wrapping of said luggage is carried out from a plurality of spools of plastic material joined together, the plastic material on said spools being provided with the advertising image.

6. An advertising arrangement as in claim 1 wherein said plastic sheet is transparent plastic material.

7. An advertising arrangement as in claim 1 wherein said plastic sheet is opaque plastic material.

8. An advertising arrangement as in claim 1 wherein said plastic sheet is translucent plastic material.

9. An advertising arrangement as in claim 1 wherein said carrier is a conveyor belt.

10. An advertising arrangement as in claim 1 wherein said carrier is a conveyor ramp.

11. An advertising arrangement as in claim 1 wherein said carrier is a roller.

12. An advertising arrangement as in claim 1 wherein said advertising image is a label.

13. An advertising arrangement as in claim 1 wherein said actuator is hydraulic.

14. An advertising arrangement as in claim 1 wherein said actuator is pneumatic.

* * * * *